United States Patent [19]

Fitzgerald

[11] 4,310,832

[45] Jan. 12, 1982

[54] BACK-LIT GRAPHIC DISPLAY PANEL APPARATUS

[75] Inventor: Charles A. Fitzgerald, Tucker, Ga.

[73] Assignee: Fitzgerald Engineering Co., Inc., Tucker, Ga.

[21] Appl. No.: 130,842

[22] Filed: Mar. 17, 1980

[51] Int. Cl.[3] ..... G09F 7/04

[52] U.S. Cl. ..... 340/381; 340/373

[58] Field of Search ..... 340/381, 366 B, 378 A, 340/373; 40/576, 577, 621

[56] References Cited

U.S. PATENT DOCUMENTS 3,624,648 11/1971 Willoughby ..... 340/381

4,101,884 7/1978 Benton ..... 340/381

*Primary Examiner*—Harold I. Pitts

*Attorney, Agent, or Firm*—Jones, Thomas & Askew

[57] ABSTRACT

A control panel for systems or processes, equipped with relatively shadow-free back illumination. The control panel includes a display panel, and a backing panel mounted behind the display panel to receive and support display interactive devices such as indicating devices or control devices. The display interactive devices may be equipped with magnetic bases for mounting on a steel backing panel. A source of back-lighting illumination is disposed behind the backing panel, and perforations in the backing panel allow the illumination to strike the rear of the display panel for relatively shadow-free back lighting.

11 Claims, 3 Drawing Figures

BACK-LIT GRAPHIC DISPLAY PANEL APPARATUS

BACKGROUND OF THE INVENTION

This invention relates in general to control panels, and in particular to graphic display control panels of the type used for displaying or controlling industrial processes or the like.

Control panels designed for monitoring and controlling the operation of complex systems, such as industrial processes or manufacturing systems, are known in the art. These control panels typically include a graphic display which visually simulates the flow path and/or operation of a particular system or process, so that an operator can monitor and control the operation of the system by observing indications appearing on the panel. The control panels may include lamps, annunciators, and other visual or audible signal devices to inform an operator when certain operating conditions, such as the operation of pumps, valves, conveyors, or the like are taking place. The control panels also frequently include switches or similar control input devices, located on the control panel in functional or logical relation to the graphic symbol denoting the controlled function, thereby enabling an operator to control a particular aspect of a system by manipulating the corresponding control device at the control panel.

Such control panels frequently include localized internal illumination to indicate the status of a particular element in the system being controlled. Because industrial systems and processes are frequently modified, necessitating corresponding modifications to the related control panels, it is known to provide the control panels with internal illumination sources that can be readily repositioned at any desired location behind the display panel. One example of such repositionable illumination sources is shown in U.S. Pat. No. 3,624,648 entitled "Graphic Display Annunciator", in which one or more lamps are magnetically attached at any desired position within the display panel. Changes in the underlying system or process are readily accommodated, simply by changing the graphic symbols on the display panel and by quickly repositioning the magnetically-mounted lamps disposed behind the display panel.

More recently, it has been proposed to mount control switches or similar actuators within the control panel and behind the display panel. The switches or actuators, as well as illumination sources denoting various process or system functions, may be mounted by magnetic or other means for ease of repositioning. The switches within the control panel are operated through the display panel by the presence of an operator's finger or by an actuating device, at or adjacent the control panel immediately in front of the behind-panel switch. Further details of within-panel switches or control actuators are found in copending patent application Ser. No. 967,111 filed Dec. 7, 1978.

While the internal mounting of indicators and control switches within a control panel enables more rapid modification of the process or system representation of the panel, and is generally more economical to manufacture because the front display panel need not be penetrated for installing switches or indicators, the physical presence of switches or indicators behind the display panel has heretofore interfered with attempts to back-light the display panel. Panel back-lighting in the past has been provided, if at all, simply by mounting one or more lamps immediately behind the display panel, casting a relatively uniform illumination over the entire panel. The ideal effect, as viewed from the front of the display panel, is a relatively diffused illumination emanating from the display panel, except as those locations where graphics deliberately obscured the illumination. However, with control panels having internally-mounted switches or indicators of the types illustrated in the foregoing patent and pending application, the physical presence of the internal devices (and the signal or control lines connected to such devices within the control panel) causes shadows to be cast on the internally-illuminated control panel. Those shadows are not only unsightly as seen from the front of the panel, but may actually detract from operator comprehension of the process or system graphically depicted on the panel.

Consequently, there is a need for a control panel which can be uniformly back-lighted, without sacrificing the advantages of indicators or control elements positioned behind the front display of the control panel.

SUMMARY OF INVENTION

According to the present invention, a control panel is provided with a display panel, a support disposed behind the display panel to support one or more display interactive devices such as indicators or controls, and with a source of back-lighting illumination mounted behind the support. The support is sufficiently transmissive of illumination to allow light from the behind-support source to uniformly cover the rear of the display panel, thereby providing a relatively uniform illumination to the panel except for areas rendered opaque by graphics, or deliberately obscured by indicators or control devices. Stated somewhat more specifically, the support for indicators or controls behind the control panel may include a perforated panel suitable to retain the indicators and/or controls in any desired position, yet sufficiently perforated to permit a necessary amount of back-illumination to pass through the perforations and impinge the rear of the display panel. More specifically yet, the support member may comprise a perforated ferrous panel, thus providing an attachment base for display or control devices having a magnetic mount.

Accordingly, it is an object of the present invention to provide an improved control panel.

It is another object of the present invention to provide a control panel with improved back-illumination.

It is still another object of the present invention to provide a control panel with improved internal means for indication or control, and also with relatively shadow-free back illumination.

Other objects and advantages of the present invention will become more apparent from the following description of a preferred embodiment.

DESCRIPTION OF PREFERRED EMBODIMENT

Figure 1:
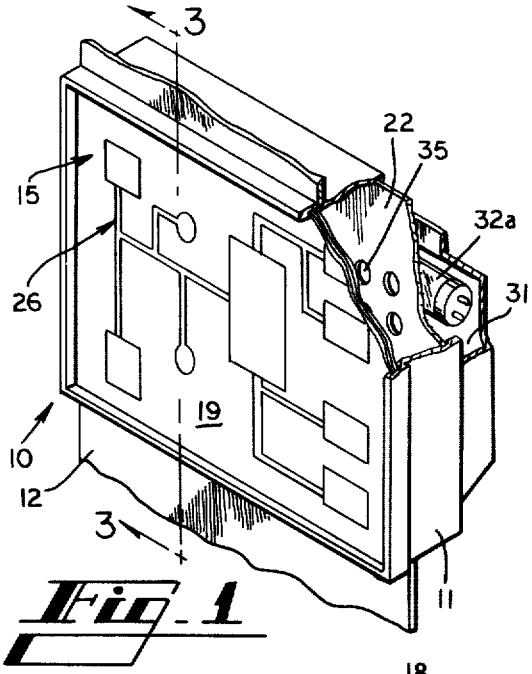
FIG. 1 shows a partially-broken away isometric view of a control panel according to a disclosed embodiment of the present invention.

Turning first to FIG. 1, there is shown generally at 10 a control panel according to an embodiment of the present invention and mounted in a surrounding housing 11. The control panel 10 is shown mounted in and carried by a vertical panel structure 12 by way of example, although it should be understood that the control panel may also be incorporated into a horizontal or diagonal control console as is known to those skilled in the art.

Figure 3:
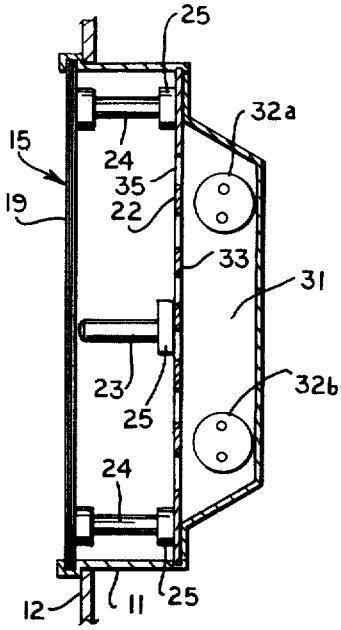
FIG. 3 is a side elevation view taken along line 3—3 of FIG. 1.
Figure 2:
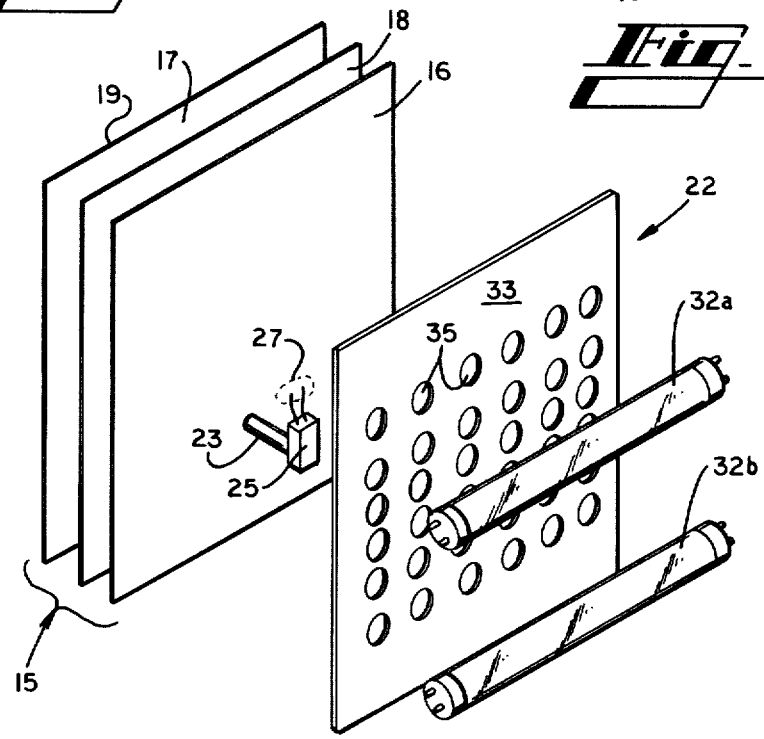
FIG. 2 is an exploded view of the panel shown in FIG. 1, with the exterior housing omitted for illustrative purposes.

The control panel 10 includes a display panel 15 which may be of conventional construction. As best shown in FIG. 2, the display panel 15 may comprise three planar layers of material sandwiched together to form the display panel shown in assembly in FIG. 3. The multilayer display panel 15 includes an innermost support layer 16 made of a transparent or translucent material such as glass, plexiglas, or the like. The outer sheet 17 is also a solid sheet of a translucent or preferably transparent material. Sandwiched between the support sheet 16 and the outer sheet 17 is the display sheet 18, which may be a relatively thin and flexible translucent or opaque material such as Mylar or the like, to which is applied art work symbols 26 (FIG. 1) of one or more contrasting colors. The art work symbols carried by the display sheet 18 are visible through the outer sheet 17, and depict the process or system for which the control panel 10 is provided. The outer sheet 17 preferably has a nonglare front surface 19, so as to reduce glare by minimizing ambient light reflection from the front surface.

Positioned a distance behind the display panel 15 within the housing 11 is the backing panel 22, which provides the mounting and support surface for one or more display interactive devices such as the indicating devices 23 and/or control devices 24. The backing panel 22 in the disclosed embodiment is stamped or otherwise formed from a sheet of ferrous material such as steel, and each of the indicating devices 23 and control devices 24 is equipped with a magnetic base 25 which allows the devices to be attached at any desired location on the backing panel, and to be readily removed and repositioned within the housing 11. It will be apparent to those skilled in the art that the several indicating devices 23 and control devices 24 are positioned on the backing panel 22 so as to have a desired spatial correlation with the graphic symbols indicated generally at 26 on the front surface 19 of the display panel. Each of the indicating devices 23 and control devices 24 has connected to it a control line 27, fragmentarily shown in FIG. 2 and omitted from FIG. 3 for clarity; it will be understood that the several control lines emanate from the control panel 10 and extend to the control or operating circuits respectively associated with the process elements depicted by the graphic symbols 26.

Mounted in a lighting chamber 31, formed behind the backing panel 22 by an extension of the housing 11, are a pair of elongated lamps **32*a* and 32*b*, and these lamps may be conventional light sources such as fluorescent tubes or the like. The mounting fixtures and associated wiring for the lamps 32*a* and 32*b* are conventional, and are omitted from depiction in the drawing. Although two such lamps are shown in the lighting chamber 31, it will become apparent that the exact number of lamps is of secondary importance to the requirement that illumination be cast onto the rear surface 33 of the backing panel 22** in a diffuse manner, such as from two or more discrete sources.

The backing panel 22 is provided with a number of perforations 35, and these perforations are of size and placement to maximize the passage of illumination from the lighting chamber 31 to the back side of the display panel 15. It will thus be seen that the primary practical limit on the ratio of perforate area to nonperforate area of the backing panel 22 is imposed by the need for the backing panel to provide mounting surfaces and support strength for the various indicating devices 23 and control devices 24 mounted on and supported by the backing panel.

The operation of the present control panel should now become apparent. The various indicating devices 23 and/or control devices 24 are positioned where desired relative to the display panel, in a manner known to those skilled in the art, and are maintained in position by magnetic attraction of the magnetic bases 25 to the ferrous backing panel 22. Illumination from at least two sources **32*a* and 32*b* within the lighting chamber 31 passes through the perforations 35 in the backing panel 22, and that illumination is applied relatively uniformly to the rear of the display panel 15. The resulting back-illumination of the display panel 15 provides an effective back-lighting effect on the translucent portions of the display panel, as viewed from the front surface 19 thereof. Because illumination from the lighting chamber 31 emanates from a position in back of the indicating devices and control devices mounted on the front of the backing panel, significantly fewer and less pronounced shadows are cast onto the back of the display panel 15 by those devices than would be the case if the lamps 32*a* and 32*b* were merely mounted within the housing 11 in front of the backing panel 22. Furthermore, by providing illumination from at least two locations within the lighting chamber 31**, which may be accomplished by plural lamps as shown or alternatively by a suitable diffuser, unwanted shadows in the back-lighting illumination are further minimized or eliminated.

Although the foregoing embodiment utilizes a ferrous backing panel 22 to provide mounting for magnetic-based indicating or control devices, it should be understood that other support-attachment arrangements may be substituted within the present invention. For example, detachable and infintely-variable mounting for the indicating or control devices could be alternatively provided by a hook-and-teasle fabric, such as Velcro fasteners, with the material being attached to the bases of the indicating or control devices and with the backing panel being a nonferrous (or even nonmetallic) perforated sheet having matching attachment material on its forward-facing surface.

It should be also understood that the foregoing pertains only to a preferred embodiment of the present invention, and that numerous changes and modifications may be made therein without departing from the spirit and the scope of the invention as defined in the following claims.

I claim:

1. Graphic display apparatus, comprising:

a light-transmissive display panel having a front side and a back side;

a support panel disposed behind said display panel in spaced apart relation to said back side, and operative to support display interactive means between said display panel and support panel in selected positions relative to said display panel;

means disposed behind said support panel to illuminate the support panel; and said support panel being perforated to allow said illumination to pass through the lamp support panel and illuminate said back side of said display panel.

2. Apparatus as in claim 1, wherein said support panel is opaque except for said perforations therein, so that illumination from said illumination means can pass through the support panel only through said perforations.

3. Apparatus as in claim 1, wherein said support panel is a metallic panel operative to support a display interactive means equipped with a magnetic member.

4. Apparatus as in claim 3, wherein:

said metallic panel has perforations of a number and shape sufficient to allow the back side of said display panel to be illuminated substantially uniformly by illumination passing through said perforations, yet not interfering with support of said display interactive means at any selected position relative to said display panel.

5. Apparatus as in claim 3, wherein:

said perforations in said metallic panel are operative to allow the back side of said display panel to be illuminated substantially uniformly by illumination passing through said perforations, without interfering with support of said display interactive means at any selected position relative to said display panel.

6. Apparatus as in claim 1, wherein said illumination means is operative to illuminate said perforated support panel from at least two directions so as to provide shadow-free illumination to said display panel.

7. Graphic display apparatus, comprising:

display means at least portions of which are light-transmissive, said display means having a first side for viewing and having a second side;

support means disposed in spaced apart relation to said second side of said display means;

said support means being operative to support at least one display interactive means between said support means and said display means in arbitrary relation relatid to said second side of said display means;

illumination means disposed behind said support means; and said support means being perforated sufficiently to allow said second side of said display means to receive substantially uniform illumination from said illumination means.

8. Apparatus as in claim 7, wherein:

said support means comprises metallic means operative to support a display interactive means equipped with a magnetic support engaging means.

9. Apparatus as in claim 7, wherein:

said support means comprises a steel panel perforated at least sufficiently to allow said illumination to pass from said illumination means disposed at one side of said panel to said display means disposed at the other side of said panel.

10. Apparatus as in claim 7, wherein:

said display interactive means includes means operative to detachably engage said support means at any selected location thereon.

11. Apparatus as in claim 1, wherein:

said display interactive means comprises light emitting means illuminating only a localized area of said display panel; and said display panel except for said localized area receives substantially uniform illumination from said illumination means, so that said localized area provides a visual contrast with said substantially uniform illumination of the display panel.

* * * * *